US010035563B2

(12) United States Patent
Ketring

(10) Patent No.: US 10,035,563 B2
(45) Date of Patent: Jul. 31, 2018

(54) FUEL STORAGE CAP FLOTATION DEVICE AND METHOD OF USE

(71) Applicant: James Randall Ketring, Escondido, CA (US)

(72) Inventor: James Randall Ketring, Escondido, CA (US)

( * ) Notice: Subject to any disclaimer, the term of this patent is extended or adjusted under 35 U.S.C. 154(b) by 0 days.

(21) Appl. No.: 15/440,597

(22) Filed: Feb. 23, 2017

(65) Prior Publication Data

US 2017/0305502 A1 Oct. 26, 2017

Related U.S. Application Data

(60) Provisional application No. 62/327,564, filed on Apr. 26, 2016.

(51) Int. Cl.
*B65D 88/34* (2006.01)
*B63B 17/00* (2006.01)

(52) U.S. Cl.
CPC ..... *B63B 17/00* (2013.01); *B63B 17/0027* (2013.01)

(58) Field of Classification Search
CPC . B63B 17/00; B63B 2017/0045; B63B 9/065; B63B 22/00; B63B 25/006; B63B 27/36; B63B 35/00; B65D 81/245; B65D 88/34; B65D 88/36; B65D 90/22; B65D 2517/0055
USPC ..... 220/216–227, 560
See application file for complete search history.

(56) References Cited

U.S. PATENT DOCUMENTS

| | | | | |
|---|---|---|---|---|
| 4,795,054 | A | 1/1989 | Brown | |
| 4,815,783 | A | 3/1989 | Montreuil et al. | |
| 5,325,882 | A * | 7/1994 | Forsythe | B60K 15/03519 137/43 |
| 5,881,907 | A * | 3/1999 | Schutz | B65D 41/083 215/274 |
| 6,935,527 | B1 | 8/2005 | Brock | |
| 7,624,889 | B2 | 12/2009 | Tharp et al. | |
| 7,703,629 | B2 | 4/2010 | Nelson | |
| 8,944,269 | B2 | 2/2015 | Green | |
| 9,096,124 | B2 | 8/2015 | Whelan et al. | |
| 2004/0110435 | A1 * | 6/2004 | Cross | B63J 99/00 440/88 F |

(Continued)

FOREIGN PATENT DOCUMENTS

| | | | |
|---|---|---|---|
| CN | 202656862 | U | 1/2013 |
| KR | 1020010019900 | A | 3/2001 |

*Primary Examiner* — Kareen Thomas
(74) *Attorney, Agent, or Firm* — Procopio Cory Hargreaves and Savitch LLP

(57) ABSTRACT

An attachable flotation device for a fuel storage cap of a watercraft, the fuel storage cap including an outer surface, an inner surface, and an engagement portion that engages a corresponding portion of the watercraft to cover access to a fuel tank of the watercraft, comprising a floatable material including a top and a bottom; and an attachment mechanism on the bottom of the floatable material that is attachable to the outer surface of the fuel storage cap to attach the floatable material to the fuel storage cap, the floatable material providing sufficient buoyancy to enable the fuel storage cap to float in water when the fuel storage cap accidentally falls in the water during refueling, preventing the fuel storage cap from sinking, and allowing the fuel storage cap to be more readily located and retrieved.

11 Claims, 1 Drawing Sheet

(56) References Cited

U.S. PATENT DOCUMENTS

2010/0059533 A1* 3/2010 Unger ..... B01L 3/52
220/694
2014/0208691 A1* 7/2014 Ballering ..... B65D 77/048
53/432

* cited by examiner

FUEL STORAGE CAP FLOTATION DEVICE AND METHOD OF USE

CROSS-REFERENCE TO RELATED APPLICATION

This application claims the benefit under 35 U.S.C. 119 of U.S. provisional patent application No. 62/327,564, filed Apr. 26, 2016, which is incorporated by reference herein.

FIELD OF THE INVENTION

The present invention relates to attachable flotation devices for watercraft fuel storage caps.

BACKGROUND OF THE INVENTION

During refueling of a watercraft (e.g., boat, personal watercraft, jet ski), one removes a fuel storage cap of the fuel storage/tank and fills the fuel storage/tank with fuel (e.g., gasoline). Because refueling of a watercraft is typically done on the water, there is a danger, especially if the water is rough, that the removed fuel storage cap can accidentally fall into the water and sink to the bottom of the body of water, making it difficult or impossible to locate and retrieve. The fuel storage cap is important because it prevents fuel in the fuel storage/tank from coming out of the tank and contaminating the body of water/environment and/or creating a flammability hazard, and prevents water from getting mixed into the fuel and damaging the engine of the watercraft.

SUMMARY OF THE INVENTION

An aspect of the present invention involves an aftermarket, stick-on flotation device for fuel storage caps of watercrafts to prevent the above-described problem with a fuel storage cap accidentally falling into the water and sinking to the bottom of the body of water during refueling. The flotation device adheres to a top of a fuel storage cap of a fuel tank/storage for a watercraft (e.g., boat, personal watercraft, jet ski) and allows the fuel storage cap to float so that one can locate and retrieve a fuel storage cap that has accidentally fallen into the water.

Another aspect of the invention involves an attachable flotation device for a fuel storage cap of a watercraft, the fuel storage cap including an outer surface, an inner surface, and an engagement portion that engages a corresponding portion of the watercraft to cover access to a fuel tank of the watercraft, comprising a floatable material including a top and a bottom; an attachment mechanism on the bottom of the floatable material that is attachable to the outer surface of the fuel storage cap to attach the floatable material to the fuel storage cap, the floatable material providing sufficient buoyancy to enable the fuel storage cap to float in water when the fuel storage cap accidentally falls in the water during refueling, preventing the fuel storage cap from sinking, and allowing the fuel storage cap to be more readily located and retrieved.

One or more implementations of the aspect of the invention described immediately above includes one or more of the following: the attachment mechanism includes an adhesive surface on the bottom of the flotation device with a removable backing to expose the adhesive surface; the floatable material has a cylindrical disc configuration; the floatable material is neoprene; the top of the floatable material includes one or more readily observable markings thereon to facilitate locating the attachable flotation device in the water; the one or more readily observable markings include one or more of a logo, artwork, a bright color, a fluorescent color, and an indicia; attaching the attachable flotation device to the fuel storage cap by attaching the bottom of the floatable material to the outer surface of the fuel storage cap via the attachment mechanism; disengaging the engagement portion of the fuel storage cap from the corresponding portion of the watercraft to uncover access to a fuel tank of the watercraft; allowing the fuel storage cap with attached flotation device to fall into the water; buoying the fuel storage cap in the water with the attached flotation device, preventing the fuel storage cap from sinking; locating the fuel storage cap with the attached flotation device in the water; retrieving the fuel storage cap with the attached flotation device from the water; engaging the engagement portion of the fuel storage cap with the corresponding portion of the watercraft to cover access to the fuel tank of the watercraft; the attachment mechanism includes an adhesive surface on the bottom of the flotation device and a removable backing and the method further includes removing the backing from the flotation device, and adhering the adhesive surface of the bottom of the attachable flotation device to the top surface of the fuel storage cap; locating the fuel storage cap with the attached flotation device in the water includes locating the one or more readily observable markings on the attached flotation device to facilitate locating the attachable flotation device in the water; and/or attaching the attachable flotation device to the fuel storage cap by attaching the bottom of the floatable material to the outer surface of the fuel storage cap via the attachment mechanism; allowing the fuel storage cap with attached flotation device to fall into the water; locating the fuel storage cap with the attached flotation device in the water; retrieving the fuel storage cap with the attached flotation device from the water.

DETAILED DESCRIPTION OF PREFERRED EMBODIMENTS

Figure 1:
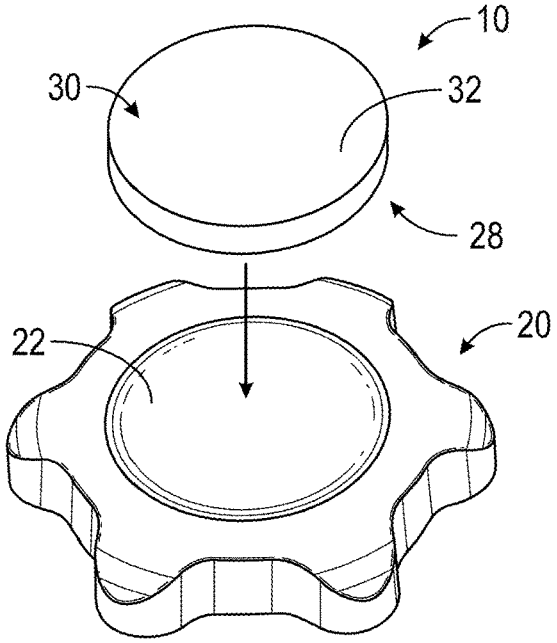
FIG. 1 is a top perspective view of an embodiment of a fuel storage cap flotation device shown above a fuel storage cap prior to application to the fuel storage cap.
Figure 2:
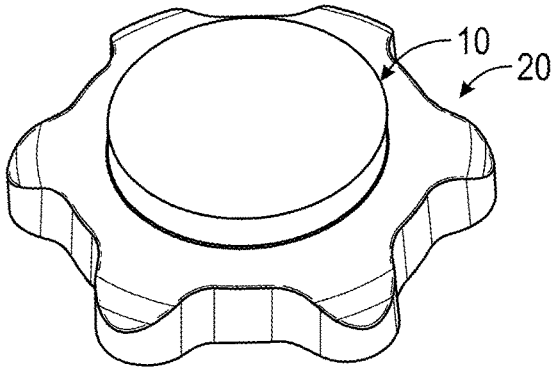
FIG. 2 is a top perspective view showing the fuel storage cap flotation device of FIG. 1 shown applied to the fuel storage cap.
Figure 3:
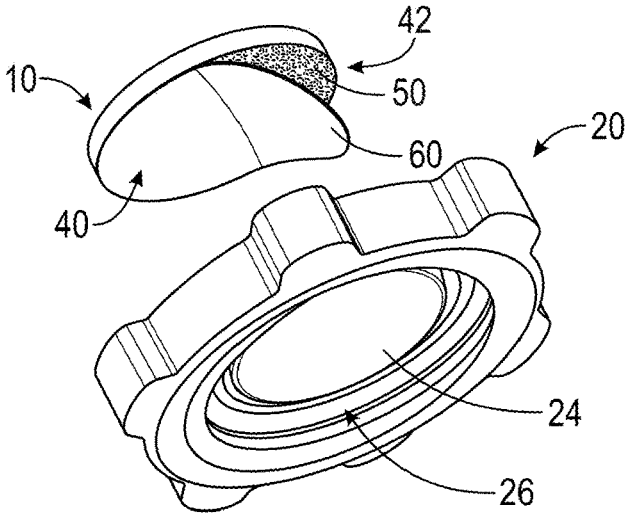
FIG. 3 is a bottom perspective view of the fuel storage cap flotation device shown above a fuel storage cap prior to application to the fuel storage cap in FIG. 1.

With reference to FIGS. 1-3, an embodiment of an aftermarket, stick-on flotation device 10 for a fuel storage cap 20 of a watercraft (e.g., motor boat, personal watercraft, jet ski) will be described. The fuel storage cap 20 includes an outer or top surface 22, an inner or bottom surface 24, and an engagement portion (e.g., internally or externally threaded portion) 26 that engages a corresponding portion of the watercraft to cover access to a fuel tank of the watercraft. The flotation device 10 is a cylindrical disc made of a floatable material 28 such as a neoprene material or other floatable material and includes a top 30 and a bottom 40. The top 30 may include one or more readily observable markings 32 such as, but not limited to, a logo, artwork, color (e.g. bright color, fluorescent color), indicia, or other marking(s), and the bottom 40 includes an attachment mechanism 42 (e.g., an adhesive surface 50 and removable backing 60).

To attach (e.g., apply, stick) the flotation device 10 to the fuel storage cap 20, the removable backing 60 is removed from the adhesive surface 50 on the bottom 40 of the flotation device 10 and the adhesive surface 50 of the bottom 40 is adhered to the outer or top surface 22 of the fuel storage cap 20.

With the flotation device 10 adhered to the fuel storage cap 20, if the fuel storage cap 20 accidentally falls into the water (e.g., before, after, or during re-fueling of watercraft), the floatable material 22 of the flotation device 10 provides sufficient buoyancy to enable the fuel storage cap 20 to float in water, preventing the fuel storage cap 20 from sinking, and allowing the fuel storage cap 20 to be more readily located and retrieved. If an embodiment where the flotation device 10 includes a bright or fluorescent color on the top 30, the bright or fluorescent color will help one to locate the fuel storage cap 20 floating in the water.

In use, the attachable flotation device 10 is attached to the fuel storage cap 20 by attaching the bottom 40 of the floatable material 22 to the outer surface 22 of the fuel storage cap 20 via the attachment mechanism 42 (e.g., the adhesive surface 50 of the bottom 40 of the attachable flotation device 10 is adhered to the top surface 22 of the fuel storage cap 20). Next, the engagement portion 26 of the fuel storage cap 20 is disengaged from the corresponding portion of the watercraft to uncover access to the fuel tank of the watercraft. Then, when the fuel storage cap 20 with attached flotation device 10 accidentally is allowed to fall into the water, then the fuel storage cap 20 is buoyed in the water with the attached flotation device 10, preventing the fuel storage cap 20 from sinking. Next, the fuel storage cap 20 with the attached flotation device 10 is located in the water (e.g., the one or more readily observable markings 32 on the attached flotation device 10 are located to facilitate locating the attachable flotation device 10 in the water). Finally, the fuel storage cap 20 with the attached flotation device 10 is retrieved from the water, and the engagement portion 26 of the fuel storage cap 20 is engaged with the corresponding portion of the watercraft to cover access to the fuel tank of the watercraft.

Another exemplary method of using the attachable flotation device for a fuel storage cap of a watercraft includes attaching the attachable flotation device to the fuel storage cap by attaching the bottom of the floatable material to the outer surface of the fuel storage cap via the attachment mechanism; allowing the fuel storage cap with attached flotation device to fall into the water; locating the fuel storage cap with the attached flotation device in the water; and retrieving the fuel storage cap with the attached flotation device from the water.

In further applications of the flotation device 10, the flotation device 10 may be used with any cap or similarly sized/weighted object in danger of falling in the water to cause the cap/object to float and be located.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. An attachable flotation device for a fuel storage cap of a watercraft, the fuel storage cap including a perimeter, an outer surface, an inner surface, and an engagement portion that engages a corresponding portion of the watercraft to cover access to a fuel tank of the watercraft, comprising:

a floatable material including a top and a bottom, the floatable material including a perimeter that is smaller than the perimeter of the fuel storage cap;

an attachment mechanism on the bottom of the floatable material;

a layer that is pulled off the bottom of the floatable material to allow the attachment mechanism to adhere to the outer surface of the fuel storage cap to attach the floatable material to the fuel storage cap, the floatable material providing sufficient buoyancy to enable the fuel storage cap to float in water when the fuel storage cap accidentally falls in the water during refueling, preventing the fuel storage cap from sinking, and allowing the fuel storage cap to be more readily located and retrieved.

2. The attachable flotation device for a fuel storage cap of a watercraft of claim 1, wherein the floatable material has a cylindrical disc configuration.

3. The attachable flotation device for a fuel storage cap of a watercraft of claim 1, wherein the floatable material is neoprene.

4. The attachable flotation device for a fuel storage cap of a watercraft of claim 1, wherein the top of the floatable material includes one or more readily observable markings thereon to facilitate locating the attachable flotation device in the water.

5. The attachable flotation device for a fuel storage cap of a watercraft of claim 4, wherein the one or more readily observable markings include one or more of a logo, artwork, a bright color, a fluorescent color, and an indicia.

6. A method of using the attachable flotation device for a fuel storage cap of a watercraft of claim 1, comprising:

attaching the attachable flotation device to the fuel storage cap by pulling off the layer off the bottom of the floatable material and attaching the bottom of the floatable material to the outer surface of the fuel storage cap via the attachment mechanism;

disengaging the engagement portion of the fuel storage cap from the corresponding portion of the watercraft to uncover access to a fuel tank of the watercraft;

allowing the fuel storage cap with attached flotation device to fall into the water;

buoying the fuel storage cap in the water with the attached flotation device, preventing the fuel storage cap from sinking;

locating the fuel storage cap with the attached flotation device in the water;

retrieving the fuel storage cap with the attached flotation device from the water;

engaging the engagement portion of the fuel storage cap with the corresponding portion of the watercraft to cover access to the fuel tank of the watercraft.

7. The method of using the attachable flotation device for a fuel storage cap of a watercraft of claim 6, wherein the floatable material has a cylindrical disc configuration.

8. The method of using the attachable flotation device for a fuel storage cap of a watercraft of claim 6, wherein the floatable material is neoprene.

9. The method of using the attachable flotation device for a fuel storage cap of a watercraft of claim 6, wherein the top of the floatable material includes one or more readily observable markings thereon to facilitate locating the attachable flotation device in the water, and locating the fuel storage cap with the attached flotation device in the water includes locating the one or more readily observable markings on the attached flotation device to facilitate locating the attachable flotation device in the water.

10. The method of using the attachable flotation device for a fuel storage cap of a watercraft of claim 9, wherein the one or more readily observable markings include one or more of a logo, artwork, a bright color, a fluorescent color, and an indicia.

11. A method of using the attachable flotation device for a fuel storage cap of a watercraft of claim 1, comprising:

attaching the attachable flotation device to the fuel storage cap by pulling off the layer off the bottom of the floatable material and attaching the bottom of the floatable material to the outer surface of the fuel storage cap via the attachment mechanism;

allowing the fuel storage cap with attached flotation device to fall into the water;

locating the fuel storage cap with the attached flotation device in the water;

retrieving the fuel storage cap with the attached flotation device from the water.

* * * * *